United States Patent [19]

Karpe et al.

[11] Patent Number: 4,506,242

[45] Date of Patent: Mar. 19, 1985

[54] TWIN-CIRCUIT BREAKER

[75] Inventors: Wolfgang Karpe; Johannes Kluge, both of Wetter; Heinz Hasselmann, Hagen, all of Fed. Rep. of Germany

[73] Assignee: Mannesmann Aktiengesellschaft, Duesseldorf, Fed. Rep. of Germany

[21] Appl. No.: 479,260

[22] Filed: Mar. 28, 1983

[30] Foreign Application Priority Data

Mar. 30, 1982 [DE] Fed. Rep. of Germany ..... 3211685

[51] Int. Cl.[3] ..... H01H 47/16

[52] U.S. Cl. ..... 335/120; 335/131; 335/136; 335/119

[58] Field of Search ..... 335/119, 120, 131, 132, 335/136, 160, 133

[56] References Cited

U.S. PATENT DOCUMENTS

| | | | |
|---|---|---|---|
| 2,358,568 | 9/1944 | Furnas et al. | 335/120 |
| 3,251,964 | 5/1976 | Lawrence et al. | 335/132 |
| 3,253,092 | 5/1966 | Landow | 335/132 |
| 3,465,270 | 9/1969 | Schattler | 335/132 |

*Primary Examiner*—E. A. Goldberg
*Assistant Examiner*—George Andrews
*Attorney, Agent, or Firm*—Ralf H. Siegemund

[57] ABSTRACT

A circuit breaker is disclosed wherein two breakers are arranged in mirror image relation having their respective contacts facing each other and abutting alternately either a common contact carrier of U-shaped configurations while double contact is prevented mechanically. In an alternative version the stationary contacts are arranged for an axial operation change. The arrangement permits reduction in internal connections as well as in space requirement without loss in function as compared with known multiple circuit breaker units.

10 Claims, 14 Drawing Figures

Fig. 3a
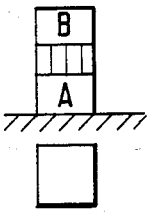
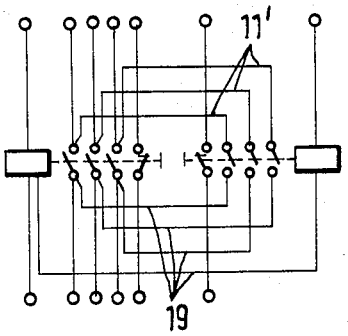
Fig. 3
Fig. 4a
PRIOR ART
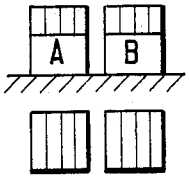
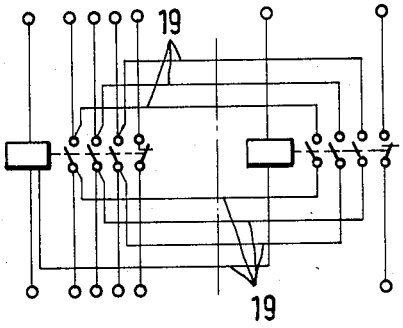
Fig. 4
Fig. 5a
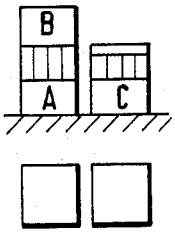
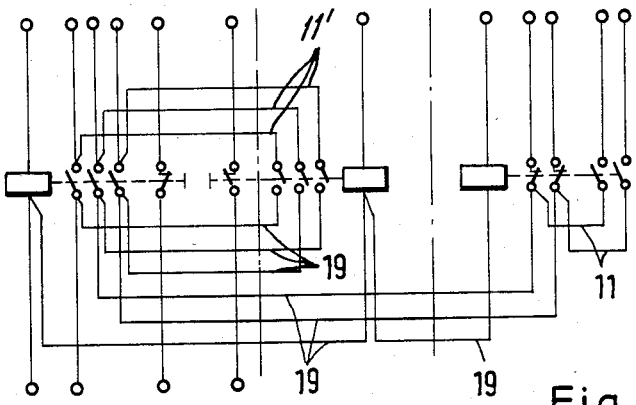
Fig. 5
Fig. 6a
PRIOR ART
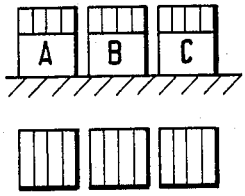
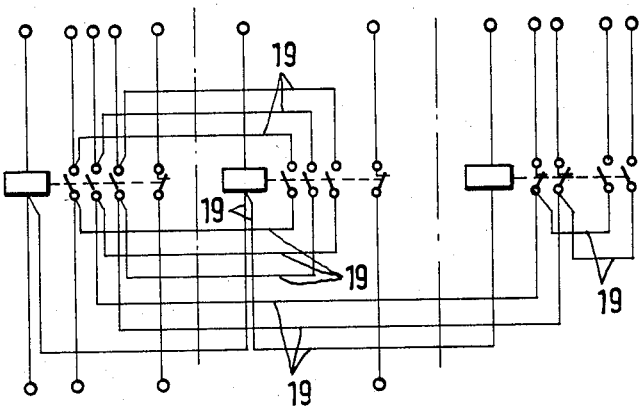
Fig. 6

TWIN-CIRCUIT BREAKER

BACKGROUND OF THE INVENTION

The present invention relates to an electromagnetically operated circuit breaker for purposes of controlling electrical motors. The circuit breaker operating by axially shifting an actuator for purposes of opening and/or closing contact.

German printed patent application No. 2,622,054 discloses a circuit breaker of the type basically to which the invention pertains. Circuit breakers to be used for controlling electro motors are usually employed in the plurality so that several of them are placed side by side on a frame plate or the like and electrical conductors interconnect them to the extent such connection is needed. A known three phase arrangement includes for example two circuit breakers and seven conductors are needed to connect them to each other, to the motor and to the source of power supply. In the case of these circuit breakers twelve such conductors are needed. The installation of these connections is extensive because each individual connection has to be made seperately including cutting the conductors at a suitable length, removal of insulation therefrom bending and fastening. In order to avoid faulty connections and particularly in order to avoid short circuits in the case of a mechanical operation, one needs either a mechanical or an electrical latching system to avoid undesired electrical connections. Another disadvantage of the known circuit breakers is a relatively high space requirement and a large area of mounting.

DESCRIPTION OF THE INVENTION

It is an object of the present invention to provide a new and improved circuit breaker structure which is of a more compact design and easy to install under utilization of a simple latching mechanism avoiding erroneous connections.

It is another object of the present invention to provide new and improved arrangement for circuit breakers being constructed to facilitate installation under avoidance of connection errors and also constructed to avoid, by operation of the construction principals involved, incorrect operating states.

In accordance with the preferred embodiment of the present invention, it is suggested to provided circuit breaker in a twin arrangement with basically a mirror image arrangement of the circuit breakers involved and having the contacts generally arranged in a facing arrangement; there being a U-shaped stationary contact carrier interposed whose legs respectively cooperate with contact making circuit breaker members mounted to movable actuators including at least one armature of the two circuit breakers. In addition, a mechanical limit, lock or stop arrangement is provided cooperating in effect between the movable portions of each of the two circuit breakers to establishe a minimum distance between the contact carrying members so that with certainty only one of them can make contact with the contact on the stationary U-shaped contact carrier.

The mirror image arrangement establishes in fact a reduction of the overall mounting surface by a factor of two and in fact the volume occupied by this arrangement is reduced to ¼ the value usually needed in the case of two circuit breakers. Moreover, the number of external circuit connections needed is reduced from seven to four in the case of a three-phase circuit breaker. In other cases the number of connecting wires is even reduced from 12 to 7. The contact making devices are configured differently as compared with the conventional construction and the mirror image arrangement of two circuit breakers establishes in effect a very easy manner for the incorporation of a blocking device because the end of the circuit breakers per se prevent interconnection between them simply on account of the mirror image arrangement.

A circuit connection is made, for example, near the bottom of the U of the above mentioned stationary contact carrier, and the legs of the U are positioned in general alignment preferably in horizontal alignment with flat, contact carrying elements individually to be connected with the U-shaped contact carrier by means of the respective contact making and circuit breaker members of the two circuit breakers. These additional flat contact elements are preferably differently constructed in that one of them at least has a crimped portion while the other is generally flat so that circuit connections to them can be made with relative ease.

The entire arrangement is preferably provided in a case or housing which may be subdivided into sections and includes generally a tubularly configured protion in which are mounted sleeve or sleeve like elements respectively carrying the movable armature elements for the two circuit breakers while portions of the sleeve are provided with extensions which are amensable to abutment to thereby establish the promixity limitation mentioned above. The stationary elements of the respective circuit breakers are arranged also within the sleeves and are fixed for immobility particularly in axial direction. The movable magnetic elements (i.e. armatures) generally and the movable sleeves in which they are mounted in particular are spring-biased such that these two sleeve elements are urged permanently in directions of opposing displacement. The movable contact carrying members are mounted in the respective sleeve extensions and extend laterally therefrom; they are also spring biased and permit to a limited extent axial displacement of the respective member within its mounting sleeve extension.

In furtherance of the invention auxiliary contacts may be provided and associated with each of the circuit breaker being basically of the same construction and following the same construction principle involved in the principal contact making operations; however, instead of a common U-shaped contact carrier, individual crimped contact carriers are provided and mounted in transverse portions of the casing in such a manner that they can be selectively positioned for contact making or contact breaking upon energization of the principal magnetic arrangements depending on the use on intent to make of these auxiliary contacts. The movable contact members are provided in pairs, but only one at a time participate in the operation, depending on the orientation of the stationary contacts.

In furtherance of the invention, the principle can be employed also in conjunction with a single electromagnetic arrangement being constructed as aforedescribed while cooperating with a second contact carrying member mounted on a plate, but having also an extension cooperating, however with the sleeve like extension of the magnetically operated device in the above mentioned, proximity limiting manner. However, this construction principal is employed here for purposes of imparting actuation upon the second contact member, as there is only one electromagnetic actuator.

It can thus be seen that the invention is to be seen in a twin arrangment of which one at least includes a movable armature element with a sleeve and a contact carrying member projecting from a sleeve extension and functioning as a mechanical actuator. When cooperating with an arrangement of a similar kind these magnetic actuators may engage mutually in order to provide proximity limiting for the two contact carrying members as they cooperate with a stationary U-shaped contact carrier and are to be kept apart at a distance larger than the spacing between the legs of the U. An alternative version includes just the proximity control extension with one contact carrying member and an overall spring bias whereby, however, the proximity control also functions as a control for opposing mode like actuation of the two sets of contacts, therefore, a plurality of different uses and connections can be provided for in which one part (i.e., one circuit breaker) is always the same, but different supplemental portions including the above mentioned auxiliary contact arrangement can be provided which involves basically very slightly different constructions of the casing housing the electrical operating parts.

DESCRIPTION OF THE DRAWINGS

FIGS. 3, 4 and 5 are circuit diagrams illustrating and demonstrating the savings in connection and incurred upon using a twin circuit breaker in accordance with the preferred embodiment;

FIGS. 3*a*, 4*a*, 5*a*, 6*a* and 6 illustrate schematically the saving of space resulting from the construction as to FIGS. 1 and 2;

Proceeding now to the detailed description of the drawings, FIG. 1 illustrates the mirror image arrangement of two circuit breakers A and B within a common case or housing 20, the arrangement being mounted to a frame plate 24. A U-shaped contact carrier 11 is disposed between the two circuit breakers A and B; particularly the device 11 is mounted on a transverse element 21 of the housing 20. The contact carrier 11 includes a bottom, as far as the "U" is concerned, being denoted by reference numeral 11*c*; legs 11*b* and 11*a* extend from that bottom bar in horizontal direction.

Figure 1:
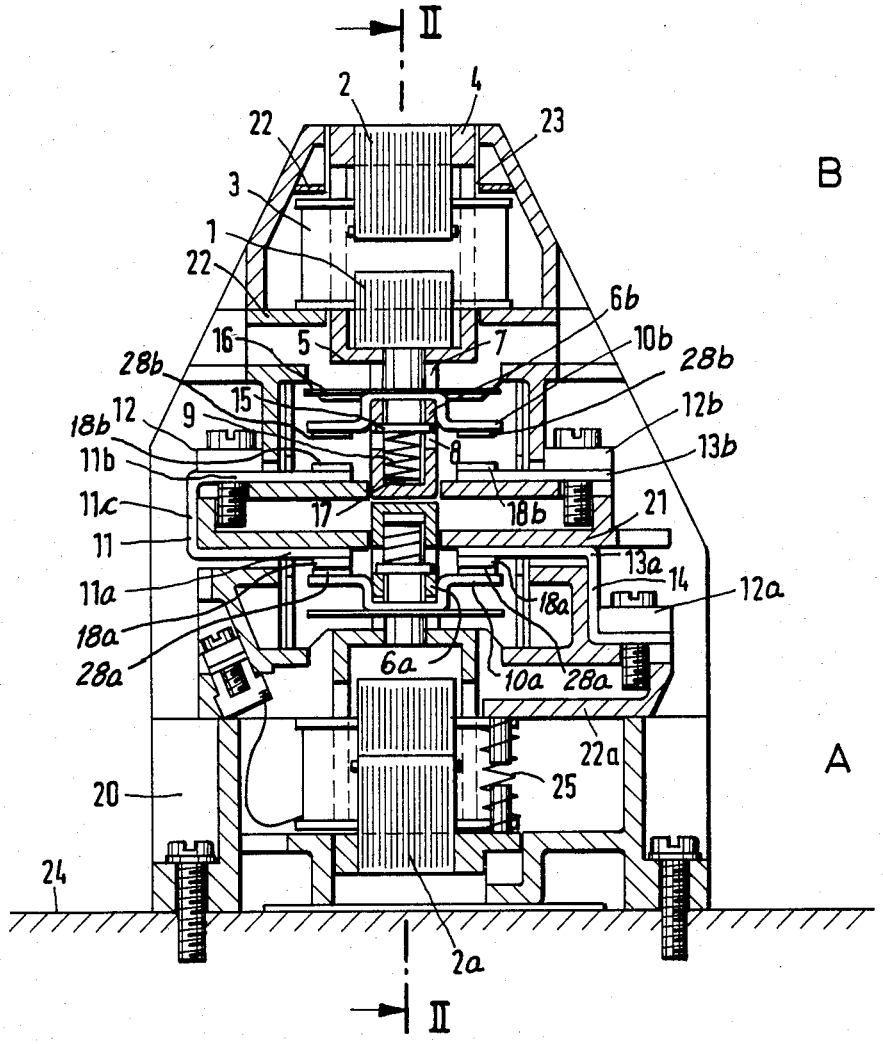
FIG. 1 is a longitudinal section view through a twin circuit breaker in accordance with the preferred embodiment of the present invention for practicing the best mode thereof.

A contact 12 is connected to the contact member 11 in the vicinity of the bottom bar 11*c*. Another contact carrier 13*a* is provided in alignment with the leg 11*a* and a contact carrier 13*b* is provided in alignment with the leg 11*b*. Two contact carriers 13*a* and 13*b* are respectively connected to connections, 12*a* and 12*b*, whereby the connection 12*a* for the circuit breaker A is connected to the respective contact 13*a* by means of a crimping 14 in the latter. The contact carrier 11 and the contact carriers 13*a* and *b* are provided with contacts proper 18*a* and *b*. These contacts cooperate with contacts such as 28*a* on a movable operating contact carrier, circuit breaker member 10*a* for the circuit breaker A and contacts 28*b* on a movable carrier member 10*b* for the circuit breaker B. These operating contact making and circuit breaker members such as 10*b* are run through slots 7 of sleeve like extensions such as 6*b* extending from an armature carrying sleeves such as 4, for circuit breaker B, there is a similar, movable arrangement provided for circuit breaker A, including a sleeve extension 6*a*.

Each of the armature sleeves 4 is axially displacably mounted and guided in a tubular guide portion 23 of the housing 20. Each armature sleeve 4 extends around a stationary magnet 1 and is connected to a movable magnet 2, there being a coil 3 interposed between the two magnets. The respective coil is held on transverse plates 22 of the housing 20. These elements are identified with the stated reference numerals with regard to the circuit breaker B, but one can readily see from the bottom portion of FIG. 1 that an analogous electromagnetic arrangement is provided for the circuit breaker A.

The armature sleeve 4 has a bottom 5 from which the sleeve extension 6 projects. This extension is provided with the contact slots 7 as stated, but is also provided with a contact pressure slot 8 for receiving a plate 15 against which bears a spring 9. This spring 9 acts upon a loop element 17 of a cooling plate 16 against which bears the contact carrier member 10*b*. This is particularly visible in FIG. 2. The contact pressure slot 8 extends for about the half of the length of the spring 9.

Figure 2:
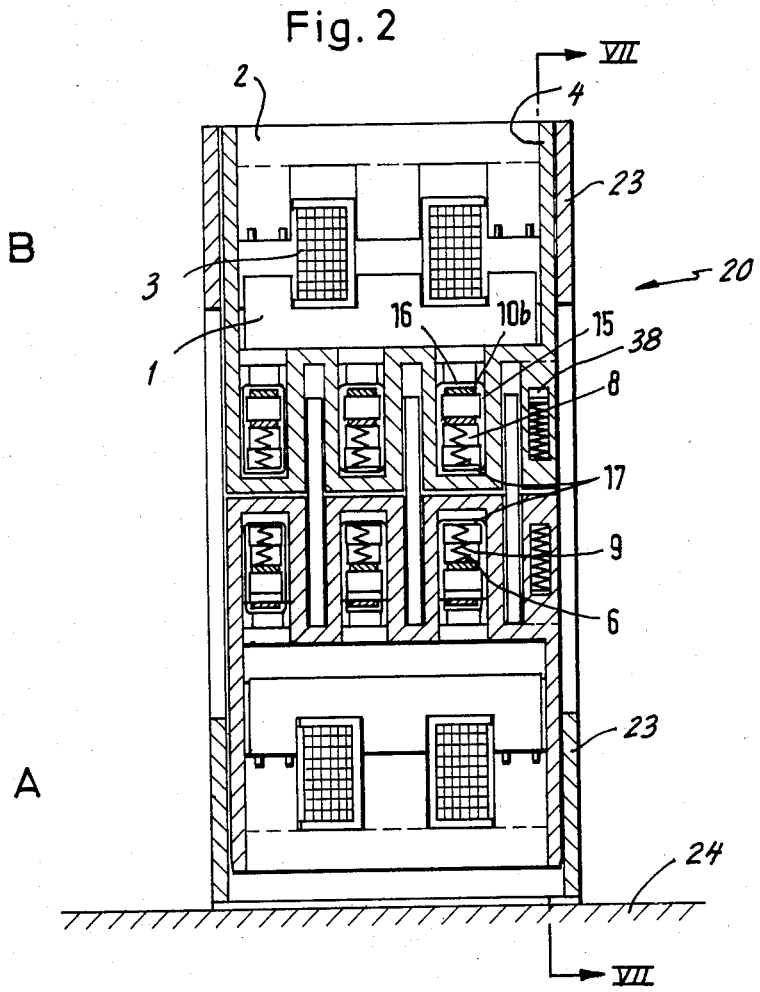
FIG. 2 illustrates a section taken along the lines II—II through FIG. 1.

In the arrangement shown in FIGS. 1 and 2, the contact of circuit breaker A are closed and those of the circuit breaker B are open, in other words the contacts 28*b* on the contact carrier and circuit breaker member 10*a* bear against the contacts 18*a* of carrier 13*a* and leg 11*a* while the contacts 18*b* are disengaged from the contacts 28*b* *on the contact carrier and member 10b*. One can see a small air gap between the two sleeve extensions 6*a* and 6*b* respectively pertaining to circuit breakers A and B and particularly well visible is the accessability to the contact connection 12*a* and 12*b*. FIG. 2 shows also, that for a three phase arrangement, three contact making and circuit breaker members per circuit breaker operate in parallel.

Springs 25 are provided for returning the respective movable magnets 2 to an initial position. These springs are particularly shown in FIG. 1. This means that in the case the respective energizing coil such as 3 is not energized, i.e., does not carry any current, the respective spring 25 causes the respective movable magnet 2 to return to an initial condition so that the respective movable contact carrier in the respective sleeve extension 6*a* or 6*b* causes its contacts to open. This is actually the operating state for the circuit breaker B. It has to be emphasized, however, that the energization of the circuit breakers A and B is completely independent from each other, in other words these two circuit breakers do not operate in opposing modes or at least they are not designed to compel them for alternating contact making operations though of course, the electrical control and operation may in fact in a specific situation cause them to operate in that manner, however, basically they are provided for independent operation in which each of these circuit breakers can have open or closed contacts, irrespective of the contact making and breaking state of the respective other circuit breaker.

FIG. 3*a* illustrate schematically in side and top elevations the space and mounting requirements for the circuit breaker arrangement of FIGS. 1 and 2. FIG. 3 illustrates correspondingly the electric circuit connection. Herein, reference numeral 19 refers to those four external electrical connections that have to be made when the two circuit breakers A and B are to be used for controlling a motor. The connections 11' are actually provided by the three U-shaped elements such as 11. In a conventional circuit breaker arrangement the additional circuit connections 11' have to made also but in the present construction, these additional connections are not needed because they are internally provided by the construction of the twin circuit breaker arrangement. FIG. 4*a* illustrates the space and mounting requirements for two conventional circuit breakers placed side by side and the circuit connections needed for controlling a motor are shown in FIG. 4. It can readily be seen that altogether seven connections 19 have to be made and the mounting space is considerably larger.

In the case of FIG. 5, three circuit breakers are assumed. The two circuit breakers A and B are mounted as per the present invention and the third one denoted by character C is positioned next to the twin arrangement. FIG. 5 illustrates the circuit connection and again only some connections 19 have to be made and installed while the connections 11' are inherent in the arrangement, particularly the construction of the twin circuit breaker A and B.

FIG. 6*a* illustrates analogously three separate circuit breakers and one can see that their space and volume requirement is higher. Moreover, FIG. 6 illustrates a circuit connections to be realized and one can see that altogether twelve connections 19 have to be completed vs. seven in FIG. 5.

Figure 7:
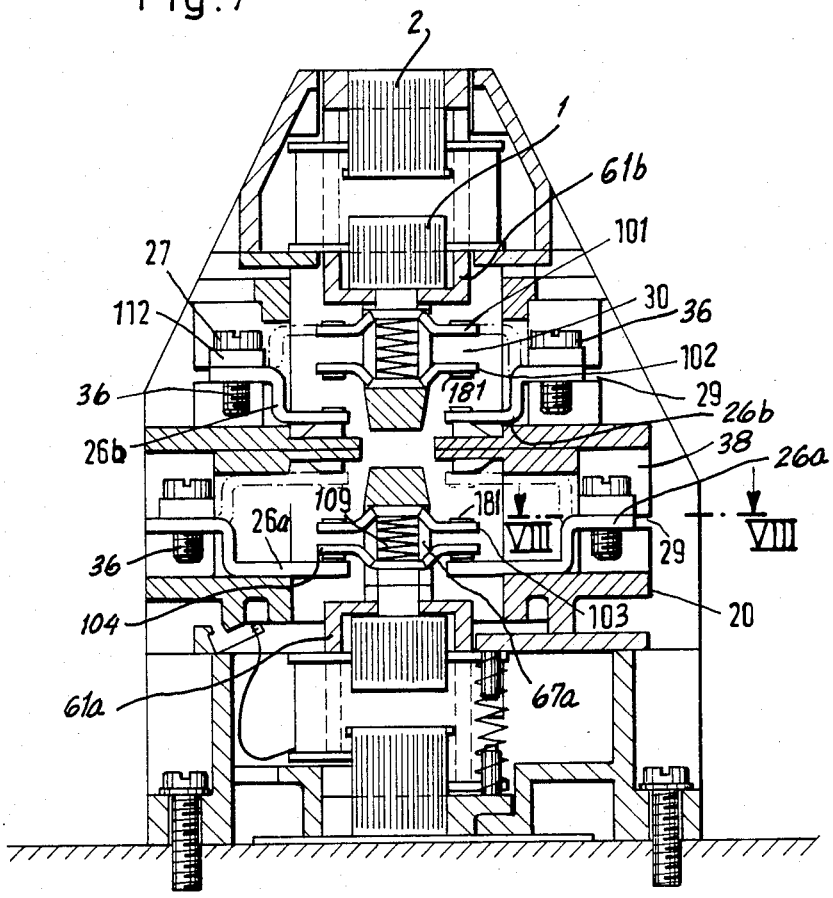
FIG. 7 is a cross-section as indicated in FIG. 2.

Proceeding now to the description of FIG. 7, it can readily be seen that an auxiliary contact chambers 38 visible also in FIG. 2, provides space for a plurality of additional contacts. First of all, there is an upper pair of movable contact carriers 101 and 102, pertaining to circuit breaker B, but only one of these carriers operates at a time. Presently carrier 102 will cooperate with supplemental or auxiliary contacts 26*b*; they are provided in an upper chamber for purposes of accomodating closing of contacts on energization of breaker B while circuit breaking action is concurrently provided for in the lower part of the drawing. The auxiliary contact arrangement includes two movable carriers 103 and 104 of which only the latter used presently, cooperating with contacts on carrier 26A.

One could turn the auxiliary contact 26*a* and/or 26*b* around as indicated by dash dot line in FIG. 7 in which case the functioning of opening and closing in the upper and lower portions of the drawing of FIG. 7 would be reversed, and contack making and/or breaking action stiffs to the second carriers (102, 103) of each set. If the upper auxiliary contact 26*b*, for example were placed into the dash dot position then the contact carrier 102 will engage the turned around contacts 26*b* and will therefore be presented from assuming the somewhat higher position illustrated in this specific situation and for the particular position of the auxiliary contacts they actually have. The contact carriers such as are actuated together with the principal contacts as per FIGS. 1 and 2.

Figure 9:
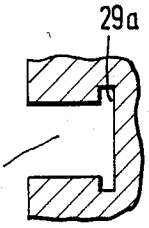
FIG. 9 is a view of the detail of FIG. 8 as indicated by arrow A therein.
Figure 8:
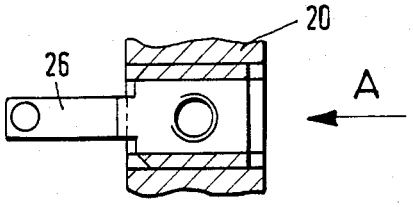
FIG. 8 is a section on an enlarged scale as indicated in FIG. 7.

In other words, the magnetic arrangements in FIG. 7 are the same as in FIGS. 1 and 2. The auxiliary contacts 26*a*, *b* are provided with crimping being in turn provided with threaded bores for receiving the threaded shanks such as 36 of screws or bolts pertaining to contacts 112. Perforations 29 in the housing 20 are provided to run the auxiliary contacts 26 to the interior contact space proper denoted with reference numeral 30. The perforations 29 are particularly illustrated in FIG. 9 and they are provided with grooves 29*a* for insertion and clamping of the auxiliary contacts 26, (being 26*a* or 26*b*) such a contact is shown in position in FIG. 8, the arrow A illustrates the view of FIG. 9.

A sleeve 61*a* extends from below into the contact space 30 the sleeve 61*a* being connected to a movable magnet. This sleeve 61*a* has a slot 67*a* for receiving the two contacts 103 and 104 having contact such as 181. The two carrier elements 103 and 104 carry these contacts so that they face in opposite direction. These contact carriers 103 and 104 are forced by means of a contact spring 109 against the ends of the slot 67*a*. This particular construction was described with reference to the lower circuit breaker; the arrangement of the upper circuit breaker arrangement is analogously constructed.

Figure 10:
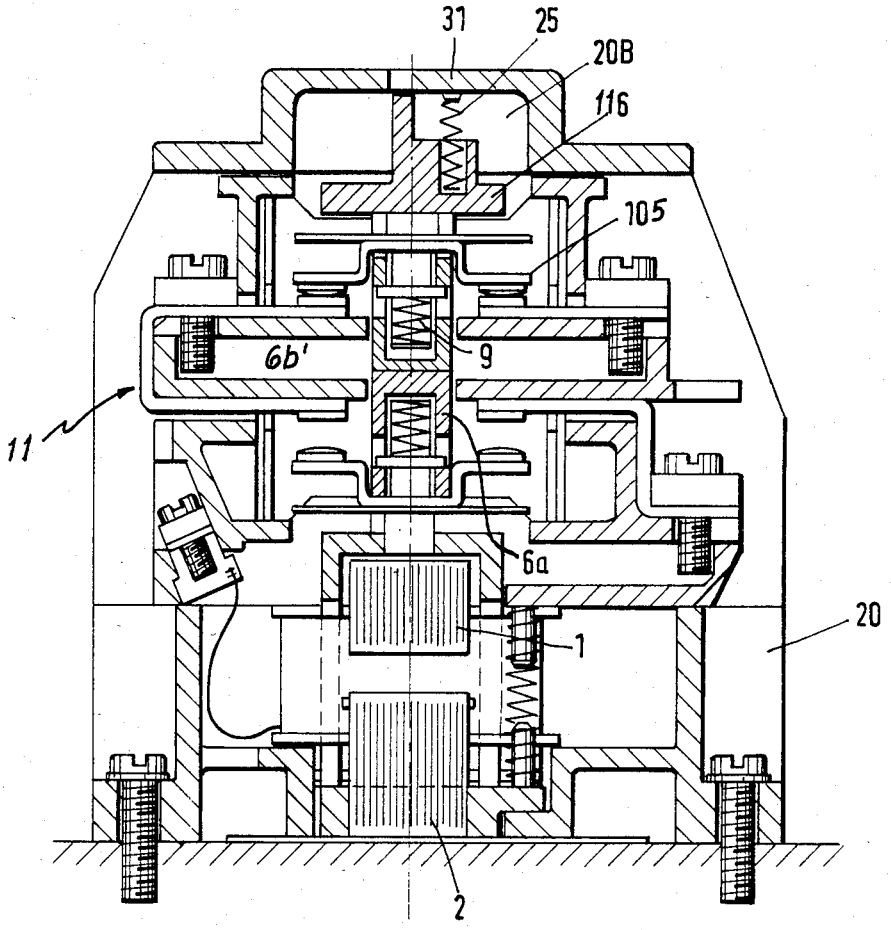
FIG. 10 is a sectional view through another embodiment of the invention.

FIG. 10 illustrates a longitudinal section through another circuit breaker in which the upper circuit breaker portion is provided with a a plate like actuating element 116 which is acted upon by a recoiling spring 25 which in turn bears with its other end in this instance against a cover 31 of the housing. The spring 25 acts upon the plate 116 to urge the plate in down direction and causes a closing of the upper sets of contacts by meanas of contact carrier 105 while causing the lower set of contacts to be opened via carrier and breaker element 10*a* whenever the one magnet (1, 2) of the electromagnetic actuation arrangement is not energized. In other words, the lower part of the illustrated structure is the same as circuit breaker A. However, upon energization of the single magnetic system the entire contact arrangement is pushed in up direction against the force of the spring 25.

Sleeve extension 6*a* pushes against sleeve extension 6*b'*, for operating the upper circuit breakers. Thus, these two circuit breakers operate strictly in a reversing mode, one opens while the other one closes. The extensions 6*a* and 5*b'* thus function not only for separating seperating the movable contact carriers sufficiently far from U-member 11, so that only one at a at a time can make contact, they also link directly the actuation of the two breakers.

The invention is not limited to the embodiments described above, but all changes and modifications thereof not constituting departures from the spirit and scope of the invention are intended to be included.

We claim:

1. A circuit breaker constructed in a twin arrangement, comprising:

a case;

a U-shaped stationary contact carrier positioned and being mounted in the case so that its legs extend in a first direction said spaced legs carrying contacts facing away from each other along a second direction;

a first electromagnetic arrangement with movable armature and being arranged generally in relation to one leg of the U-shaped contact carrier along said second direction;

a first sleeve slidably disposed in said case for movement along said second direction and carrying said armature of the first electromagnetic arrangement;

a first circuit breaker member mounted to the first sleeve and provided for contact making with the contact of the U-shaped contact carrier on the one leg;

a second electromagnetic arrangement with movable armature and arranged generally in relation to another leg of said U-shaped contact carrier;

a second sleeve slidably disposed in said case for movement along said second direction and carrying the armature of the second electromagnetic arrangement;

a second circuit breaker member mounted to the second sleeve and provided for contact making with the contact of said U-shaped stationary contact carrier;

additional stationary contact means electrically separated from each other and situated in the case for contact making with the first or the second circuit breaker means respectively when said circuit breaker means makes also contact with the contacts on one or the other leg of the U-shaped contact carrier; and mechanical means projecting from the first and second sleeve towards each other in the second direction of movement and provided for mutual engagement to keep said circuit breaker members apart from each other at a minimum distance such that they cannot both engage the contacts on said U-shaped stationary contact carrier.

2. The circuit breaker as in claim 1 and said additional contact means including flat contacts carriers respectively aligned with the legs of the U-shaped stationary contact carrier and respectively provided for contact making and breaking cooperation with contacts on said circuit breaker members.

3. The circuit breaker as in claim 2 one of said flat contact carriers being provided with a crimp, the crimped portion in erecting spacing from another one of the contact carriers and being provided for a connection to a current lead in.

4. Circuit breaker as in claim 1 and including recoiling springs acting respectively on said movable armatures.

5. A circuit breaker constructed in twin arrangement and comprising:

a case including a generally tubularly configured portion;

a first and second element of overall sleeve-like construction and being slidably disposed in said tubularly configured porrtion of the case, each of said sleeves having bottom portions from which extend respectively sleeve like extension elements, the sleeve element of the first sleeve capable of abutting the sleeve extension element of the second sleeve to thereby define limit positions for each of said first and second sleeves;

movable armatures afixed to said first and second sleeves and respectively cooperating with stationary magnetic elements disposed within said sleeves;

U-shaped stationary contact carrier positioned in an orientation and mounted in the case so that its legs respectively face said sleeves and having at its spaced legs contacts facing said sleeves and away from each other;

contact carrying circuit breaker members mounted in said sleeve like extensions and carrying contacts respectively cooperating for contact making and breaking with the contacts on said U-shaped carrier; and additional contacts being electrically separated and being stationary disposed in general alignment with the legs of said U so that said movable contact elements provide circuit connections between the legs and said additional contacts.

6. A circuit breaker as in claim 5 including auxiliary contact carrying members mechanically linked to said movable armature and cooperating with stationary contacts.

7. A circuit breaker as in claim 6, there being two auxiliary contact carrying members connected to each of the armatures, only one of said auxillary members cooperating with additional stationary contacts, there being means for mounting these stationary contact to cooperate with one or the other of the members for contact making depending upon the disposition of the respective armature.

8. Circuit breaker in twin arrangement comprising:

an electromagnetic structure, including a stationary part and a movable armature element, the movable armature element being mounted in a movable sleeve;

a first sleeve extension, extending form a bottom portion of that sleeve and having perforations;

a contact-carrying circuit breaker member resiliently mounted in said sleeve extension and projecting from the perforation thereof in lateral directions;

U-shaped contact carrier, having two legs, one of the legs provided for cooperating with a contact on said contact-carrying member;

an actuating element, constructed generally to include a second sleeve extension, having a perforation accordingly and resiliently carrying a second contact-carrying circuit breaker member projecting laterally therefrom and having contacts one of which for cooperating with a contact on the other leg of the U;

additional stationary contact means electrically separated from each other and situated in the case for contact making with the first and the second circuit breaker means respectively when said circuit breaker means makes also contact with the contacts on one or the other leg of the U-shaped contact carrier;

said second sleeve extension mounted for displacement relative to but also for engagement with said first sleeve extension such that the distance between the two contact-carrying members is larger than the spacing between said legs the second contact member as provided for contact-making with the contact with the other one of that length, providing for such contact-making when said first-mentioned contact-carrying member is retracted from the respective U-leg; and operaing means acting on said actuating element for urging same in a direction opposing the electromagnet so that depending upon energization and de-energization of the electromagnet, contact making by one or the other of the two contact carriers is obtained.

9. Circuit breaker as in claim 8 said operating means include another sleeve and another electromagnetic device having an armature in said last mentioned sleeve and operated indpendently from the first-mentioned electromagnetic device.

10. Circuit breaker as in claim 8, wherein said operating means is a spring-biased plate, causing the extensions to remain in mutual abutment.

* * * * *